US008365496B1

(12) United States Patent
Saebi

(10) Patent No.: US 8,365,496 B1
(45) Date of Patent: Feb. 5, 2013

(54) COMPOSITE BUILDINGS AND METHOD OF CONSTRUCTING COMPOSITE BUILDINGS

(76) Inventor: Nasser Saebi, Glendale, AZ (US)

( * ) Notice: Subject to any disclaimer, the term of this patent is extended or adjusted under 35 U.S.C. 154(b) by 218 days.

(21) Appl. No.: 12/658,545

(22) Filed: Feb. 10, 2010

Related U.S. Application Data

(60) Provisional application No. 61/207,422, filed on Feb. 10, 2009.

(51) Int. Cl.
*E04B 1/00* (2006.01)

(52) U.S. Cl. ..... 52/741.41; 52/742.13

(58) Field of Classification Search ..... 52/742.13, 52/742.14, 745.05, 746.1, 741.41
See application file for complete search history.

(56) References Cited

U.S. PATENT DOCUMENTS 5,044,296 A * 9/1991 Finn ..... 114/263
6,230,741 B1 * 5/2001 Woodling et al. ..... 137/615
6,985,832 B2 * 1/2006 Saebi ..... 702/189
7,128,016 B2 * 10/2006 Olthuis ..... 114/266
7,291,400 B2 * 11/2007 Yokochi ..... 428/511

* cited by examiner

*Primary Examiner* — Basil Katcheves
(74) *Attorney, Agent, or Firm* — Albert W Davis, Jr.

(57) ABSTRACT

The invention provides a method of constructing a composite building using plastic foam pieces and Glass Fiber Reinforced Concrete or GFRC, by providing pieces of plastic foam to a building site, joining the pieces of foam with a bonding agent to create at least a portion of the building from the foam pieces, providing the GFRC in a dry form according to a GFRC formula having various ingredients, blending the ingredients to premix the GFRC, placing the dry form GFRC into a mixer, adding water to the dry form GFRC and mixing the water and dry form GFRC to form a wet form of GFRC, allowing the wet form of GFRC to hydrate, providing a tower, placing a pump on the tower, the tower being higher than portion of the building to be sprayed, placing the wet form GFRC in the pump, pumping the wet form GFRC through a hose having a spray nozzle and spraying the GFRC onto the foam surface of the at least a portion of the building.

5 Claims, 1 Drawing Sheet

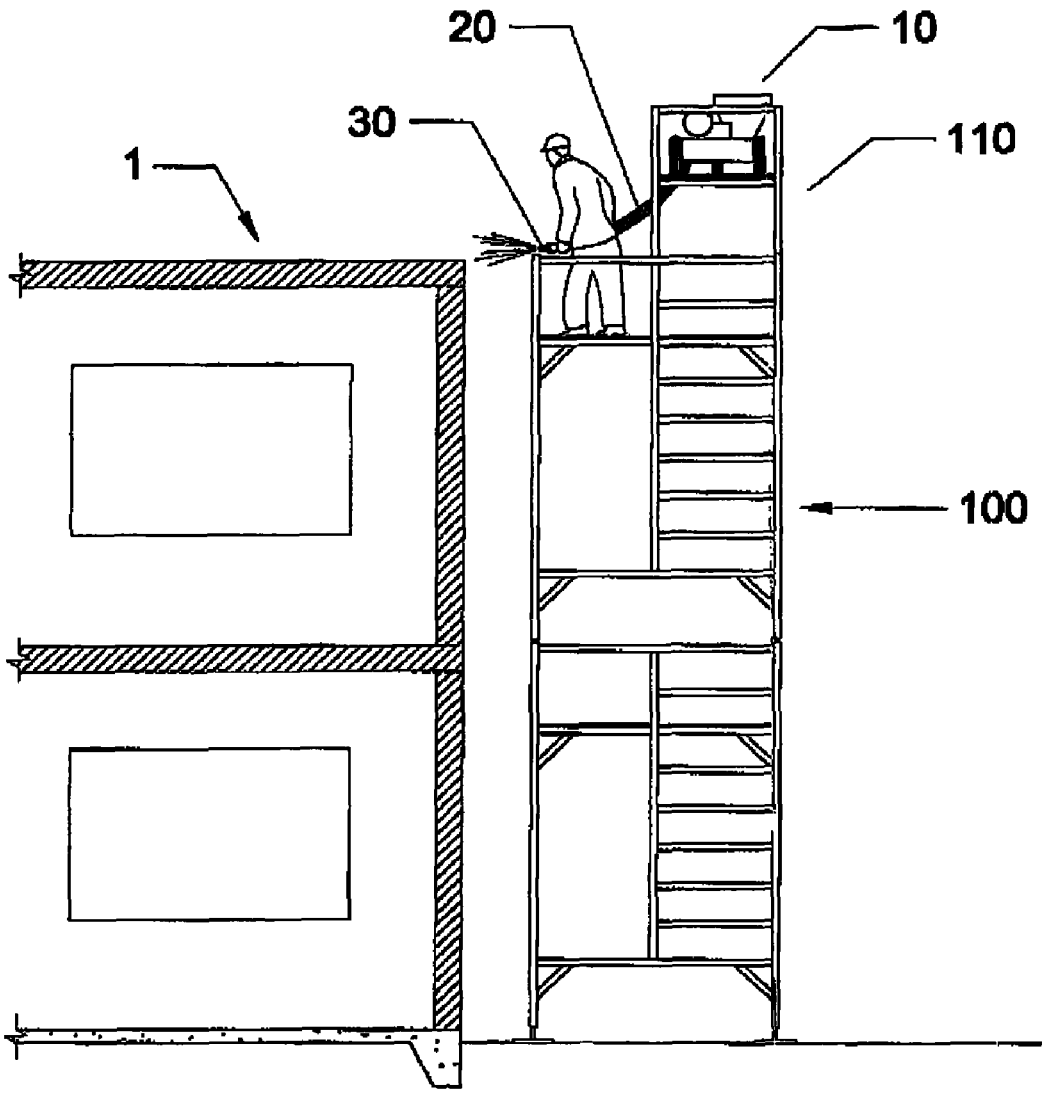
20
10
30
110
1
100

COMPOSITE BUILDINGS AND METHOD OF CONSTRUCTING COMPOSITE BUILDINGS

CROSS-REFERENCE TO RELATED APPLICATIONS

This application claims priority from provisional patent application Ser. No. 61/207,422 filed Feb. 10, 2009 for Composite Buildings And Methods Of Constructing Composite Buildings by Nasser Saebi.

The following references are incorporated by reference: U.S. Pat. No. 6,308,490 issued Oct. 30, 2001 and U.S. Pat. No. 6,912,488 issued Jun. 28, 2005 to Nasser Saebi for Method of Constructing Curved Structures as Part of a Habitable Building, U.S. Pat. No. 6,721,684 issued Apr. 13, 2004 and U.S. Pat. No. 6,985,832 issued Jan. 10, 2006 to Nasser Saebi for Method of Manufacturing and Analyzing a Composite Building.

BACKGROUND OF THE INVENTION

The invention constructs buildings of composite materials, such a plastic foam and Fiber Reinforced Coatings (FRCS).

This invention has been verified by a Finite Element Analysis (FEA). The inventor's patent U.S. Pat. No. 6,721,684 teaches how to perform the FEA.

BRIEF DESCRIPTION OF THE DRAWINGS

FIG. 1 is a schematic view of the invention.

BRIEF SUMMARY OF THE INVENTION

This invention provides an apparatus and method for coating a plastic foam building with GFRC (Glass Fiber Reinforced Concrete) at a building site. The building or portions of the building are joined with a bonding agent from pieces or panels of plastic foam. Then the walls, ceilings, floors, roof and other parts of the building are coated with GFRC. The GFRC coating can be as thin as 0.25 inch.

The preferred plastic foam is Expanded PolyStyrene (EPS) of a density of 1.5 pounds per cu. ft. (nominal) which is actually 1.35 pounds per cu. ft. (actual). Alternatively, a lighter plastic foam, such as Type I (1.0), foam can be used.

High strength foam can allow portions of the building to be constructed of foam alone while still withstand high winds as long as the proper sequence of steps are followed to ensure stability of the building. Coating of areas of the building may be necessary to ensure the needed stability. The building can be put through a FEA to determine the sequence of steps needed for constructing a building while maintaining stability.

DETAILED DESCRIPTION OF THE INVENTION

Preferably, the GFRC is blended using dry forms of the ingredients in a blending facility. The blended dry form of GFRC is trucked from the facility to the building location and off-loaded. The blended dry form of GFRC can be in bags containing, for example 50, 100, 3,500 pounds, or in hoppers on the truck that can be emptied into bins or containers.

The plastic foam pieces are provided to the building site. The site is prepared for construction. The foam pieces are erected on the prepared site and bonded to each other by a suitable bonding agent to form at least a portion of the building.

The ceiling of the building can be held up by braces or shores. If the building is multistory, braces or shores are placed to brace the ceilings of higher stories. The braces or shores should be placed vertical alignment with the brace below, all of the way down. If the building is multistory, scaffolding can be erected to provide access to the higher outer walls.

The foam walls are coated with GFRC by spraying the wet form of GFRC. The blended dry form of GFRC is placed in a mixer and mixed with water to form the wet form of GFRC. The wet form of GFRC is allowed to hydrate so that it can be sprayed.

As shown in FIG. 1, a pump 10 for the wet GFRC is preferably provided at a higher point than the area to be sprayed on the foam of the building 1 which reduces the need for a higher power pump. The pump can be placed on a support such as the scaffolding 100, a tower 110 on the scaffolding 100 or a tower 110 alone to achieve the desired height.

The pump 10 feeds into a hose 20 with a spray nozzle 30 on the end. The GFRC is sprayed on to the foam surfaces of the walls, ceiling and floor of the building.

In an alternate method of construction, one or more trucks can take the equipment to the building site. The equipment can be storage bins or tanks which store the cement, sand, fibers, polymer or other dry components. The feed from the bins can be regulated by valves which can be manually set or automatically controlled by sensors that detect the feed rate and provide the desired volume of ingredient. The bins can feed into a chute with a conveyor screw that carries the dry ingredient to a cement mixer. Water and other liquid components can be added at the cement mixer. The mixed concrete/GFRC can then be provided to a pump.

As an example of suitable components, the mixer and the pump could be the D-25 Continuous Mixer and the P-25 Mortar Pump from Machine Technologies of Haslet, Tex.

The dry mixture can be added directly into the hopper of the mixer and the liquids supplied in the outlet feed screw of the mixer, as in the D-25 Mixer.

Alternatively, the storage bins can feed into a container or wheelbarrow that is used to hand feed the mixer. The dry mix of concrete, sand and fibers or any combination of these ingredients can be premixed and put in bags or containers that are fed into the mixer. The polymer, retarder or plasticizer can be in the dry premix if it is obtainable in the dry form.

The pump can be moved to and from the mixer after being loaded with mixed cement and used to coat various areas of the foam building. Alternatively, the pump can be situated at the mixer and a long hose is used to coat the various locations of the building. Any combination of methods may be used at a building site.

A mobile unit, a trailer or a truck can house bins that hold all of the dry ingredients in the bins and a cement mixer and/or a cement (GFRC) pump. The bins can feed controlled volumes of the ingredients into a conveyor, such as a screw conveyor, which can convey the dry ingredients to a mixer which would mix the dry ingredients. The output of the mixer can have a screw conveyor which inputs the liquid ingredients conveys and mixes the ingredients. The output of the screw conveyor can then be fed to the GFRC pump.

The GFRC can be sprayed onto the surface using a mortar nozzle which uses compressed air at the nozzle to add velocity to the GFRC. Such spray nozzles are obtainable from Benron Equipment & of Van Nuys, Calif.

As an example, a suitable formula for Type I GFRC can be:

1 bag of cement (Portland Cement Type I)—94 pounds,

No. 30 silica sand—100 pounds, water—22 pounds,
polymer (Forton™ VF-774)—12 pounds,
retarder (Daratard™ 17)—2-5 ounces,
plasticizer (Daracem™ 19)—2-6 ounces and
0.75 inch glass fibers (Cem-FIL™)—3.0 pounds.

This formula using Type I Portland Cement GFRC can be used because the assembled foam alone is strong enough to prevent the building from being destroyed by normal to high winds during the 7 days needed to attain final strength of the GFRC coating. The bonding agent holding the foam together should be a non-water soluble bonding agent since rain could affect its strength.

GFRC can be made from all Types of Portland Cement (Type I, II, III, IV and V). The type of cement used is dependent on the requirements of the job (fast or slow setting, etc.), the sulfate content of the sand and other conditions.

Basically, GFRC can be made with all types of cement. If the use of Type III Portland cement is avoided, the process of mixing and handling is streamlined since the problems of the quick setting of the cement and of the need for the ice are eliminated. The Portland Cement Type III creates excessive heat when mixed with water.

Thus, an advantage of using Type I (Portland) GFRC is that the heat generated by the curing is much less than that for Type III which mitigates or removes the need for measures, such as using ice. Further, Type III Portland Cement may not be as readily available as Type I Portland Cement.

The Type III Portland Cement GFRC coating attains final strength in 10-11 hours and could be used if very high winds were expected.

Portions of the building could be coated with Type III GFRC to quickly provide high enough strength to withstand winds and other loads experienced during construction, such as worker weight and movement, equipment, etc.

Then, the rest of the building could be coated with Type I GFRC. That is, Type III GFRC can be used where final strength is needed quickly, such as in any beam that must provide strength when forming a roof, ceiling or floor. The Type III GFRC could be applied to the beams in a factory or at the building site or at another location closer to the site than the factory.

Type III GFRC could also be applied to some of the walls for quick strength, and Type I GFRC applied to others.

Type I Portland Cement GFRC can be used to form a final or intermediate coating over the Type III GFRC to join a Type III GFRC coating to an adjacent foam surface or to another Type III GFRC coating or to another Type I GFRC coating.

The amount of retarder will vary with the weather conditions.

The fibers can only be short fibers, 0.5 inch, instead of 0.5 inch and 1.5 inch fibers. However, the fibers can be a mixture of lengths, such as 0.5 and 1.5 inch fibers. Preferably, the fibers can all be 0.75 inches.

A non-structural bonding agent can be expansive plastic foams, such as Expansive PolyUrethane (EPU), etc.

The type of plastic foam can be different from Expanded PolyStyrene (EPS). The EPS can have a density of 1.5 pounds per cu. ft. (nominal) which is actually 1.35 pounds per cu. ft. (actual). EPS was used because a Finite Element Analysis was done using EPS and GFRC. Suitable plastic foam could be PU, EPS, etc.

Various changes and modifications to the embodiments herein chosen for purposes of illustration will readily occur to those skilled in the art.

The mixer can be a paddle or tumbler mixer.

The application of the GFRC coating can be by spraying, hand application with various tools, a gravity fed application from a chute, etc.

The specific materials used to build the structure may be varied, such as the type of plastic foam, the bonding agents, the coatings, etc.

The FRC can be a Glass Fiber Reinforced Concrete (GFRC) or a Fiber Reinforced Polymer (FRP). The fibers can be plastic, glass, carbon, single-wall carbon nanotubes (SWNTs or Buckytubes), Aramid or other fibers. The Polymer can be Epoxies, Polyesters, Vinlyesters or other materials.

The coating also can be without fibers if the design loading is low enough. For the strongest structure, fibers should be added to the coating. The number of coats of the coating and the composition of those coats can be varied.

Bonding agents that bond foam to foam, foam to concrete and concrete to concrete can be structural or non-structural as certified by International Code Council (ICC). One structural bonding agent is Glass Fiber Reinforced Concrete (GFRC). A thickness of 0.25-0.50 inches is suitable.

The shell or surface coating can be done in two coats of 0.25 inches to make sure that there is 0.25 inches everywhere. After the first coat of GFRC has cured to the point that that bracing is no longer needed, the braces can be removed. Then, when the second coat of GFRC on the ceiling and floor is applied, the second coat bonds with the first coat, covers the bare spots on the foam that were covered by the load spreaders on the braces and provides a continuous shell.

A formula for Type III GFRC is:
1 bag of cement (Portland Cement Type III)—94 pounds,
No. 30 silica sand—100 pounds,
water and ice—25 pounds,
polymer (Forton™ VF-774)—12 pounds,
retarder (Daratard™ 17)—2-5 ounces,
plasticizer (Daracem™ 19)—2-6 ounces,
0.5 inch glass fibers (Cem-FIL™ or Nippon AR™)—1.5 pounds and
1.5 inch glass fibers—1.5 pounds.

A non-structural bonding agent can be expansive plastic foams, such as Expansive PolyUrethane (EPU), etc. This can be used where the joint strength need not be structural, such as a joint that is later covered with FRC to create structural strength.

The type of plastic foam can be different from Expanded PolyStyrene (EPS). The EPS can have a density of 1.5 pounds per cu. ft. (nominal) which is actually 1.35 pounds per cu. ft. (actual). EPS was used because a Finite Element Analysis was done using EPS and GFRC. Suitable plastic foam could be PU, EPS, etc.

The specific materials used to build the structure may be varied, such as the type of plastic foam, the bonding agents, the coatings, etc.

To the extent that such modifications and variations do not depart from the spirit of the invention, they are intended to be included within the scope thereof which is assessed only by a fair interpretation of the following claims.

I claim:

1. A method of constructing a composite building using plastic foam pieces and Glass Fiber Reinforced Concrete or GFRC, comprising the following steps,
providing pieces of plastic foam to a building site,
joining the pieces of foam with a bonding agent to create at least a portion of the building from the foam pieces,
providing the GFRC in a dry form according to a GFRC formula having various ingredients,
blending the ingredients to premix the GFRC, placing the dry form GFRC into a mixer, adding water to the dry form GFRC and mixing the water and dry form GFRC to form a wet form of GFRC, allowing the wet form of GFRC to hydrate, providing an elevated support, placing a pump on the elevated support, the elevated support and the pump being higher than portions of the building to be sprayed to reduce the required power of the pump, placing the wet form GFRC in the pump on the elevated support, pumping the wet form GFRC through a hose having a spray nozzle, the spray nozzle being lower than the pump so as to decrease the power needed by the pump to spray the GFRC and spraying the GFRC onto the foam surface of portions of the building.

2. The method of claim 1 including the following steps, blending the dry form GFRC at a blending facility, trucking the blended dry form GFRC to the building site and off-loading the blended dry form GFRC at the building site.

3. The method of claim 2 including the step of, providing the blended dry form GFRC in bags.

4. The method of claim 2 including the step of, providing the blended dry form GFRC in a hopper in the truck and off-loading from the hopper in to a bin.

5. The method of claim 1 in which, the elevated support is a tower.

* * * * *